US006343508B1

(12) United States Patent
Feller

(10) Patent No.: US 6,343,508 B1
(45) **Date of Patent: *Feb. 5, 2002**

(54) METHOD FOR REPRESENTING PROPERTIES OF ELONGATED TEXTILE TEST SPECIMENS

(75) Inventor: Peter Feller, Benglen (CH)

(73) Assignee: Zellweger Luwa AG, Uster (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/120,236

(22) Filed: Jul. 22, 1998

(30) Foreign Application Priority Data

Jul. 25, 1997 (CH) ..... 1796/97

(51) Int. Cl.[7] ..... G01L 5/04; G06T 11/20
(52) U.S. Cl. ..... 73/159; 345/440; 73/160
(58) Field of Search ..... 73/159, 788, 789, 73/791, 160; 364/470.14, 471.03; 702/155, 182; 345/440, 441, 442, 443

(56) References Cited

U.S. PATENT DOCUMENTS

| | | | | |
|---|---|---|---|---|
| 3,610,899 A | * | 10/1971 | Dahlin | 73/73 |
| 3,840,302 A | * | 10/1974 | Brunton et al. | 356/167 |
| 3,934,241 A | * | 1/1976 | Weigert | 345/48 |
| 4,000,402 A | * | 12/1976 | Higham | 235/151.1 |
| 4,675,147 A | * | 6/1987 | Schaefer et al. | 376/245 |
| 4,758,968 A | * | 7/1988 | Lord | 73/160 |
| 4,947,684 A | * | 8/1990 | Balakrishnan | 73/159 |
| 5,146,550 A | * | 9/1992 | Furter et al. | 700/143 |
| 5,178,008 A | * | 1/1993 | Aemmer | 73/160 |
| 5,457,851 A | * | 10/1995 | Mondini | 19/115 R |
| 5,524,413 A | * | 6/1996 | Fukuda | 53/64 |
| 5,537,811 A | * | 7/1996 | Pidoux et al. | 73/160 |
| 5,557,716 A | * | 9/1996 | Oka et al. | 345/440 |
| 5,581,678 A | * | 12/1996 | Kahn | 345/444 |
| 5,611,034 A | * | 3/1997 | Makita | 345/440 |
| 5,834,639 A | * | 11/1998 | Meier et al. | 73/160 |
| 5,966,126 A | * | 10/1999 | Szabo | 345/348 |
| 6,130,746 A | * | 10/2000 | Nevel et al. | 356/238.2 |

FOREIGN PATENT DOCUMENTS

| | | |
|---|---|---|
| DE | 92 03 819.0 | 6/1992 |
| EP | 0 249 741 | 12/1987 |
| JP | 55-155212 | 12/1980 |
| JP | 58-132615 | 8/1983 |
| JP | 58-180911 | 10/1983 |

* cited by examiner

*Primary Examiner*—Hezron Williams
*Assistant Examiner*—Michael Cygan
(74) *Attorney, Agent, or Firm*—Burns, Doane, Swecker & Mathis, L.L.P.

(57) ABSTRACT

The invention relates to a method for representing properties of elongated textile test specimens such as yarns, rovings and ribbons. In order to create a method which makes values of parameters or measurement results in general ascertainable at a glance even in large numbers and nevertheless also takes differentiated account of critical and less critical parameters or measurement results, values of parameters are plotted along axes which are arranged inclined or substantially concentric relative to one another. A parameter is preferably also represented as a segment (31–36) of a circle, wherein the angle between two axes which intersect in the center of the circle and bound the segment is proportional to the importance of the parameter in a predetermined connection and the radius of the segment is proportional to the measured value for the parameter.

14 Claims, 5 Drawing Sheets

METHOD FOR REPRESENTING PROPERTIES OF ELONGATED TEXTILE TEST SPECIMENS

FIELD OF THE INVENTION

The invention relates to a method for representing properties of elongated textile test specimens such as fibres, yarns, rovings, ribbons and flat textile materials.

BACKGROUND

It is known for measured values from yarn evenness tests to be represented graphically in bar charts, wherein there is assigned to each measured value a bar the height of which is proportional to the measured value or to the qualified result of a comparison of the measured value with a desired or limit value. Such bars are typically arranged next to one another, so that a kind of profile is obtained.

It is likewise known for letters to be assigned to such qualified results, so that for each measured value or for each measurement series the result as a whole is characterized by a letter.

Since the number of measurable values on a yarn keeps on rising over time, an increasing number of bars or letters have to be juxtaposed for said known representations. This kind of representation therefore becomes more and more complicated and unwieldy, so that in the end it is no longer worthwhile or only causes confusion. In addition, a differentiation between critical and less critical values thereby becomes impossible.

SUBJECT OF THE INVENTION

The object of the invention, as characterized in the claims, is therefore to create a method which makes the values of parameters or measurement results in general ascertainable at a glance even in large numbers and nevertheless also takes differentiated account of critical and less critical parameters or measurement results.

This is achieved by values of parameters being plotted along axes which are arranged inclined or substantially concentric relative to one another. Preferably the axes are inclined relative to one another at an angle which is proportional to the importance of the one parameter. The parameter is preferably also represented as a segment of a circle, wherein the angle between two axes which intersect in the center of the circle and bound the segment is proportional to the importance of the parameter in a predetermined connection and the radius of the segment is proportional to the measured value for the parameter. Preferably a measured value is transformed in a manner such that the poor values are outside and the most probable range for the measured values lies between a minimum and a maximum diameter. The measured values can be transformed by logarithmizing and by forming an absolute value or reciprocal value for a deviation etc. Alternatively, the measured value is transformed by means of known statistical values into a cumulative frequency value and the latter is transformed into a quantile, wherein a standard distribution is assumed and the radius increases linearly relative to the quantile. It can thus be ensured that all limit and/or desired values lie on an identical radius. Measured values are plotted versus a time for a parameter and mean value and scatter are calculated therefrom and compared with previously set targets for desired values, limit values and scatter. The scatter can for example also be indicated by a circle or other figures or a color-coded edge of the segment. Attributes representing a quality of a test specimen can be determined from the measured values, mean values, limit values and scatters. Said attributes can be plotted instead of or as parameters along the axes. The resolution of the parameters can also be varied, either by selectable steps for the refinement or in such a way that parameters whose values indicate errors are represented in greater detail.

The advantages obtained by the invention can be considered in particular to reside in the fact that an overall assessment of a test specimen, i.e. for example of fibres of a yarn, roving, ribbon or other textile material, can be facilitated and be achieved by electronic processing of the measured values etc. The intended application of the test specimen can be considered without any problems when processing the measured values and the assessment be made with it in mind. If various test devices are used for the determination of the measured values, the results can nevertheless appear in a single representation. Comparisons with absolute values, limit values etc. can be made for the representation, or comparisons can be made with known statistically determined values, such as the so-called USTER STATISTICS, or with values of a reference test specimen.

BRIEF DESCRIPTION OF THE DRAWING

The invention will be explained in detail by means of an example and with reference to the attached figures, where FIGS. 1 and 2 each show a first representation of properties, FIGS. 3 and 4 each show a further representation of properties, FIGS. 5 and 6 each show an auxiliary chart for the representation of properties, and FIGS. 7, 8, 9 and 10 each show a representation of properties of a test specimen with varying resolution.

DETAILED DESCRIPTION

Figure 1:
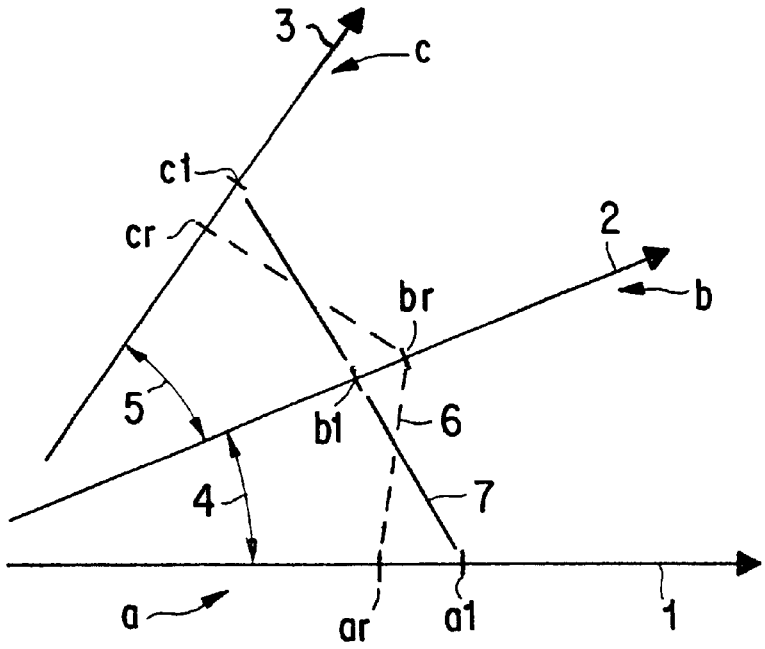

FIG. 1 shows axes 1, 2 and 3, which are each inclined at an angle 4, 5 relative to one another, and along which values for a parameter a, b, c are plotted. For example, there are entered here for each parameter a, b, c the values al, bl, cl and the reference values ar, br, cr. Limit values, desired values, mean values etc. are only a few examples of such reference values. If the plotted reference values ar, br, cr are connected by lines, a reference profile 6 is obtained. If the plotted measurement values al, bl, cl are connected by lines, a measurement profile 7 is obtained. Comparison of the profiles by eye permits a first rapid assessment of the measured values in comparison with the reference values.

Figure 2:
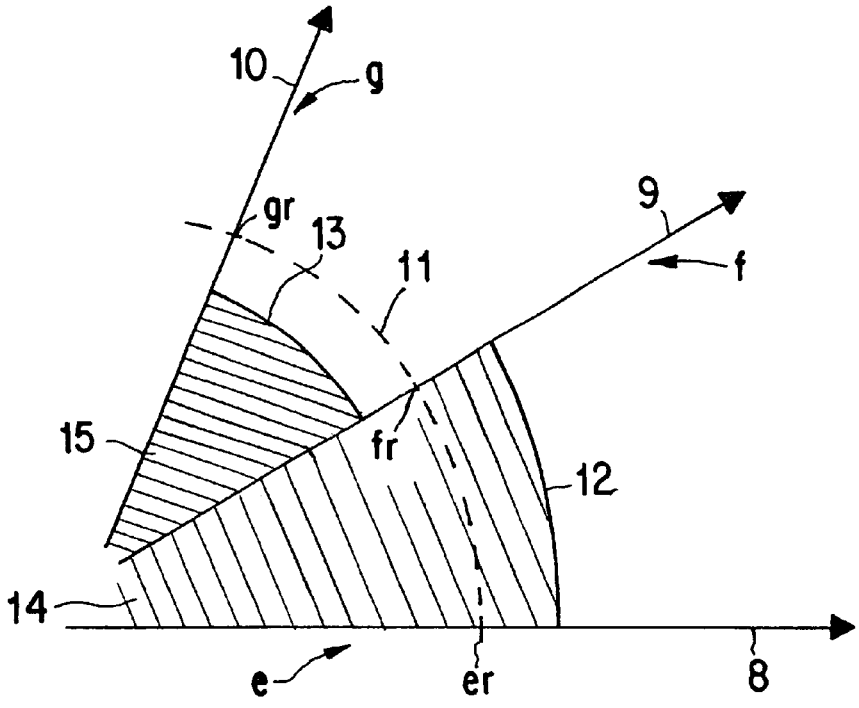

FIG. 2 shows for example axes 8, 9, 10 for parameters e, f and g, wherein the graduation of the values along the axes 8, 9, 10 and the position of the reference values or zero points is selected so that the reference values er, fr, gr lie on a continuous curve 11. Starting with measured values el, fl etc., curve sections 12, 13 are drawn, which run roughly parallel with the curve 11. The length of sections of the curve 11 between adjacent axes is for example a criterion for the relative importance of the parameters on the adjacent axes. If it is further assumed that values which are unfavourable are plotted in the arrow direction of the axes, and values which are favourable in the direction opposite to the arrow on the axes 8, 9, 10, so that an area 14, 15 between the axes and the curve sections 12, 13 can also provide a quality criterion or a rating of the measured values of the parameters.

Figure 3:
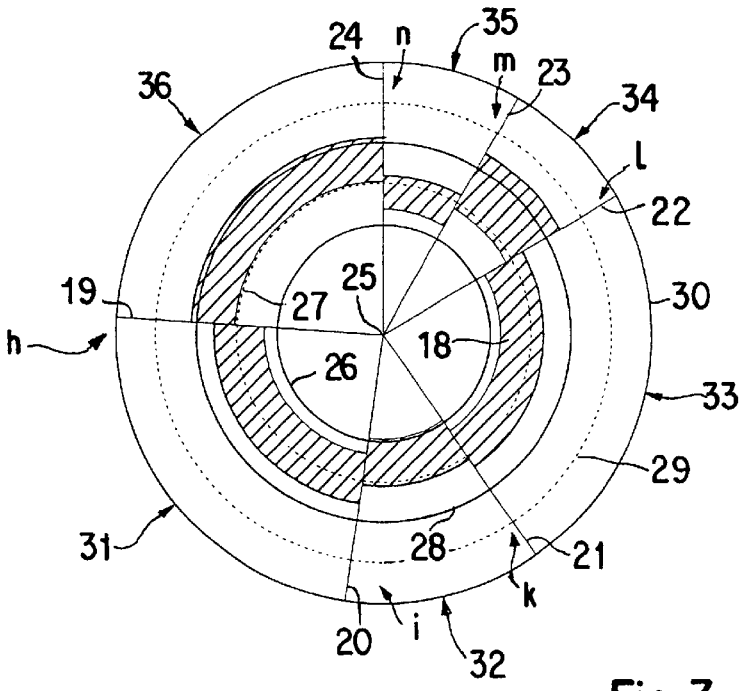

FIG. 3 shows a graph with axes 19, 20, 21, 22, 23, 24 along which, as already described above, values for parameters h, i, k, l, m, n and associated reference values are plotted. Since the axes 19–24 here meet in a center 25, various concentric circles 26, 27, 28, 29, 30 are provided, which can represent different reference values. Between the axes 19–24 are formed sectors 31, 32, 33, 34, 35, 36, whose size corresponds to the importance of a parameter in terms of an overall assessment of properties of the test specimen. A hatched area 18 indicates here for example for each sector 31–36 a region in which measured values from a test preferably lie or should lie.

This arrangement can however also be regarded in such a way that innumerable axes are notionally provided for one and the same parameter in a sector, or correspondingly that axes are only notionally provided and circles which give reference values or measured values and bound areas are visible. The distinguishing between individual parameters can be obtained by colors or other graphical means.

Figure 4:
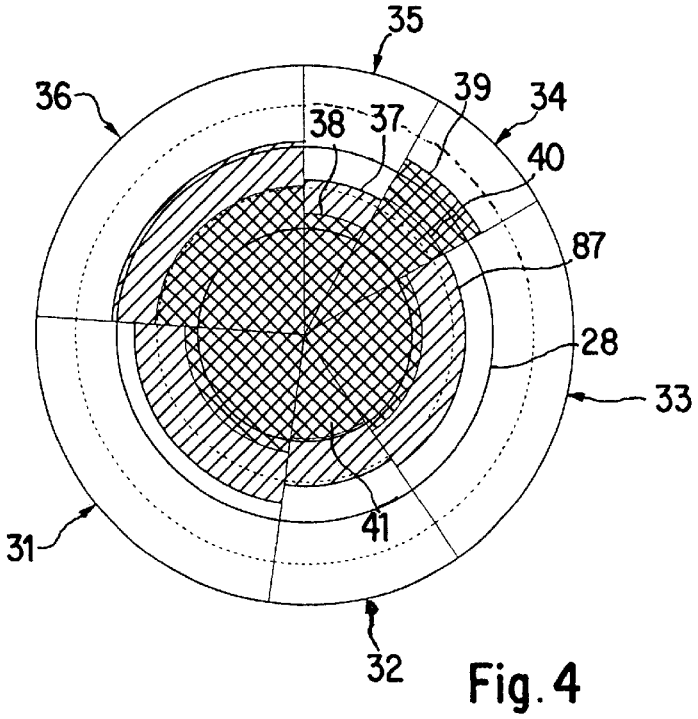

FIG. 4 shows an example corresponding to FIG. 3, with the same axes and circles, which are therefore also provided with the same reference symbols (even if they are not always included for ease of comprehension). Measured values and reference values are represented here by the radial position of segments, or by the size of an area between adjacent axes, the center 25 and a segment.

As a concrete example, we can assume that said FIG. 4 is to provide an overall representation of the quality of a yarn. FIG. 4 comprises sectors 31 to 36 and in each sector are plotted reference values and at least one measured value, which relate to a property of a yarn which is expressed by a parameter. In order not to deal with all six sectors, for the sake of simplicity only two of the latter will be described in detail below. In FIG. 4 the measured values are represented in relation to two different reference systems. The one reference system uses statistically determined comparison values which are dimension figures for the frequency of measured values in a population. Such reference values obtained from the statistics are arranged for identical frequencies on a circle. For further frequencies, different reference values are arranged on different, concentric circles. The other reference system is formed by a so-called yarn profile. The latter specifies for a specific application of the yarn desired values and limit values for the measured values of a parameter. Moreover both measured values and reference values are transformed in a suitable manner for said representation.

In the sector 35 the number of weak zones per unit of length will for example be represented in a yarn as test specimen by a segment 38. A further segment 37 in said sector 35 represents the reference value of the whole profile. The segment 38 lies close to the center and shows that the value is good compared with the population of the compared yarns and belongs to the better part, that therefore here in particular a small number of weak zones amounting to less than the average has been measured. The segment 38 lies moreover within the segment 37, which means that it can also be rated as suitable for the intended application. The weak zones and other values are measured for example by a tensile testing device and thus further values, such as maximum force, elongation, work, modulus etc., which are measured on the test material by the same device, can be represented in adjacent sectors.

In the sector 34 values for the number of thick places measured are represented by a segment 39 and the reference value of the yarn profile by a segment 40. This corresponds to a poor rating. On the one hand, the number of thick places measured lies above the mean value of the population, which corresponds to the circle 28. On the other hand, and more importantly for the assessment, it must be recognized that the segment 39 lies outside the segment 40 and the measured value exceeds the limit value for the intended application and hence must be rated as unsuitable. The number of thick places per unit of length of yarn is determined in a yarn tester which can supply further values. Such further values could be entered in adjacent sectors. The overall rating of the yarn is reproduced here by the form and size of the twin-hatched area 41, which extends over all the sectors. The more said area 41 is concentrated inwards, the better is the quality of the yarn.

Figure 5:
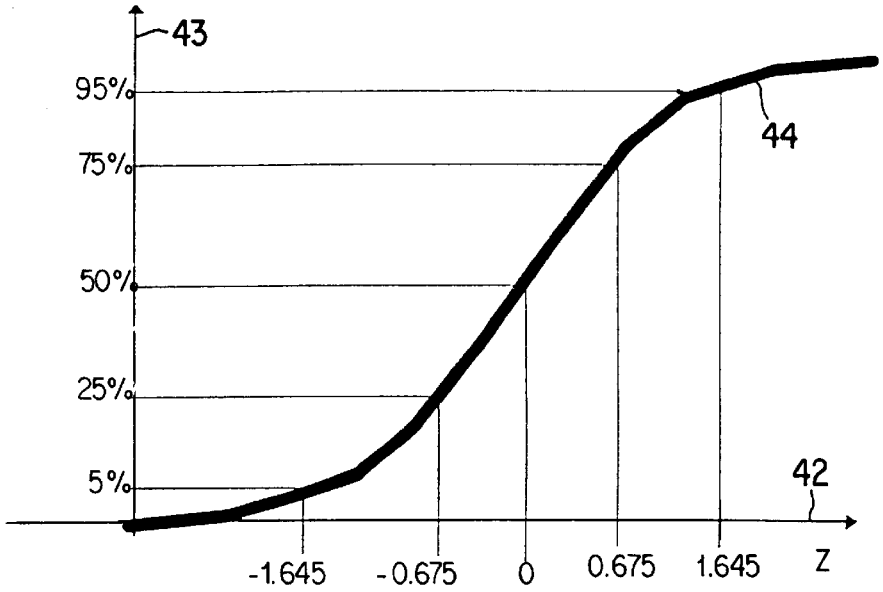

FIG. 5 shows an auxiliary graph with two axes 42 and 43, wherein so-called Z values are plotted along the axis 42, such as are known from the statistics for standard distributions. Along the axis 43 are entered values for frequencies, such as are known in general from the statistics and can be derived for example for a measured value from the so-called USTER STATISTICS, which are published by the company Zellweger Uster in Uster. Said values of the frequencies in the USTER STATISTICS indicate for a parameter the number of yarns (percentage) in a large number of measured yarns which at least reach a predetermined value for the parameter. By means of a curve 44 such percentages from the axis 43 can be converted into standardized Z values for a uniform statistical consideration.

Figure 6:
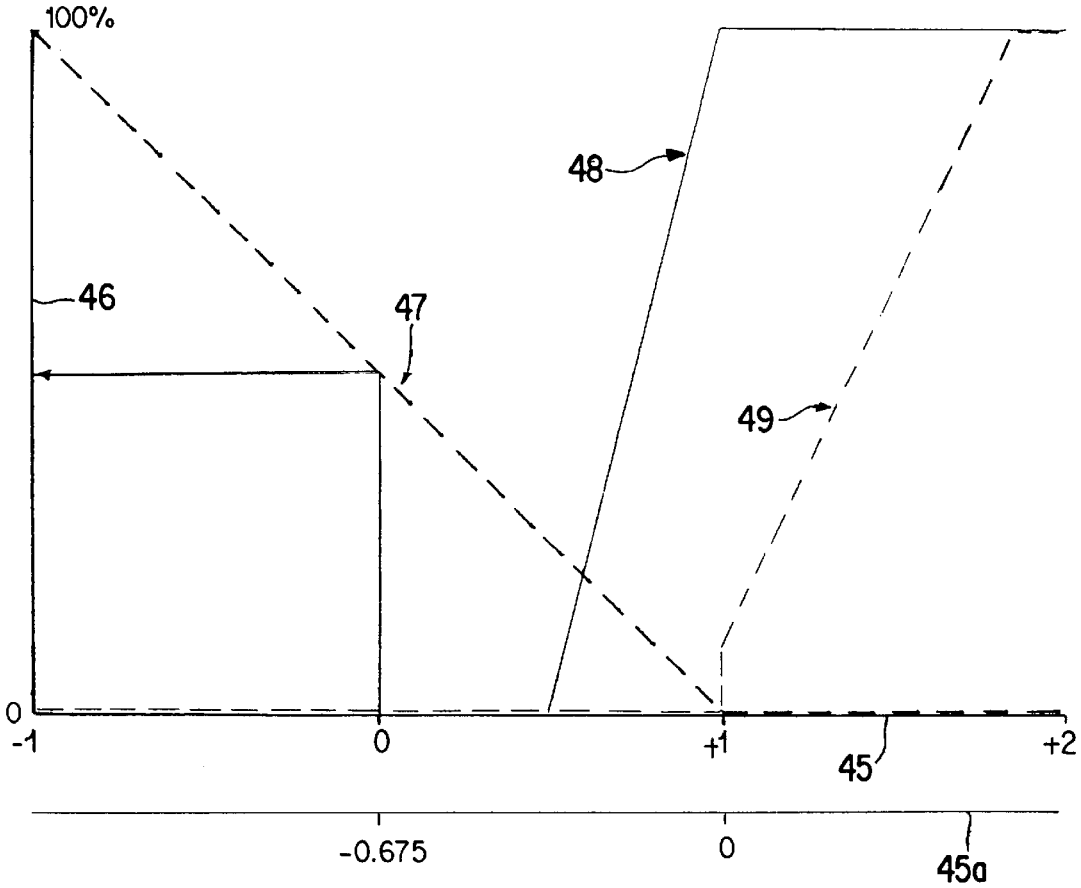

FIG. 6 likewise shows an auxiliary graph with two axes 45 and 46, wherein the same values are plotted along the axis 45 as along the axis 42 in FIG. 5. Along the axis 46 are entered values for probabilities from 0 to 100%. In the field defined by the two axes 45 and 46 there are plotted by means of lines for example three functions 47, 48 and 49. Each function 47, 48, 49 refers to a probability that a particular statement or a particular fact is applicable. In this example the function 47 indicates the probability with which a measured value is to be regarded as good. The function 48 indicates the probability with which a measured value is to be regarded as attained or applicable to a limited extent. The function 49 indicates the probability with which a measured value of a parameter is to be regarded as unsuitable or inapplicable. The auxiliary graphs according to FIGS. 5 and 6 are important for the application of a fuzzy logic. In the representation chosen the desired value lies on the axis 45 at the value Z=0 and the limit value at the value Z=1. The transformation such as that represented by this figure indicates how a measured value compared with the population is to be assessed. The desired value and the limit value can also have a different magnitude depending on the application of the test specimen or the yarn. If the yarn is intended for a particularly demanding use, the desired values and the limit values are somewhat smaller. With a less demanding use they are slightly bigger. The yarn profile expresses this. In such cases the axis 45 can therefore also be transformed linearly onto an axis 45*a*.

Figure 7:
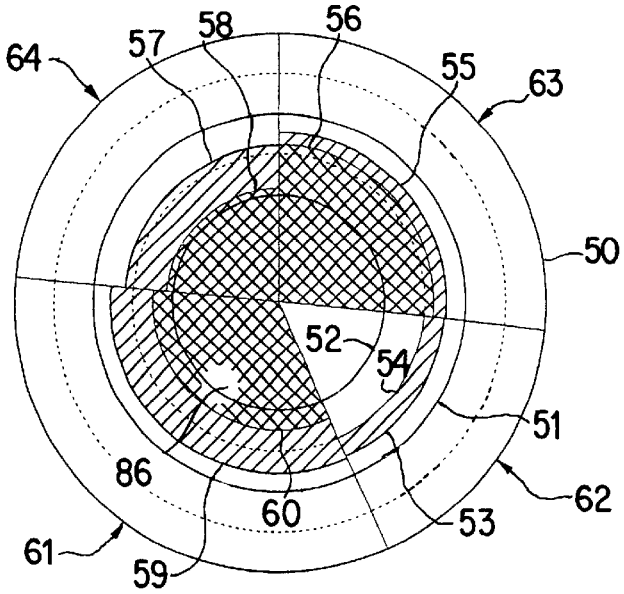

FIG. 7 shows a representation for an overall assessment of a test material, here in particular a yarn. As is already known from the previous figures, solidly drawn circles 50, 51, 52 indicate transformed reference values which are derived from the statistics, in particular the USTER STATISTICS, and correspond to frequency values. The segments 53, 55, 57, 59 lying on or between them indicate transformed reference values which together form a yarn profile and the segments 54, 56, 58, 60 indicate measured values. These are in this case the measured values which have been obtained from the testing of the yarn for example by an evenness tester in the sector 61, from the testing of the outer structure in the sector 62, from the testing in a tensile test device in the sector 63 and from the classification of thick and thin places in the sector 64. The representation corresponds to a low resolution, since only very generalized statements can be derived here.

Figure 8:
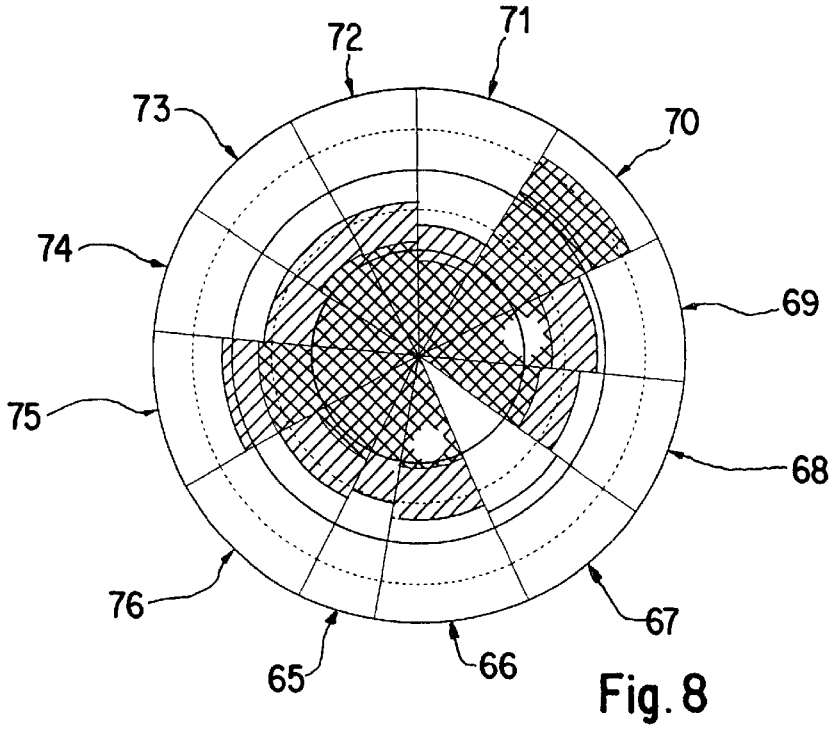

FIG. 8 shows a corresponding but refined representation similar to that in FIG. 7 but with mean resolution. A greater number of sectors therefore has to be provided for associated parameters. These are in particular sector 65 for the hairiness, sector 66 for the evenness of the material mass or of the diameter of the yarn, sector 67 for the torsion, sector 68 for the fineness, sector 69 for the elongation, sector 70 for the tensile force, sector 71 for the number of weak zones per unit of length, sectors 72, 73, 74 for results of a classification of thick and thin places etc. It should be noted that the sectors 69, 70, 71 here form collectively the sector 63 in FIG. 7.

Figure 9:
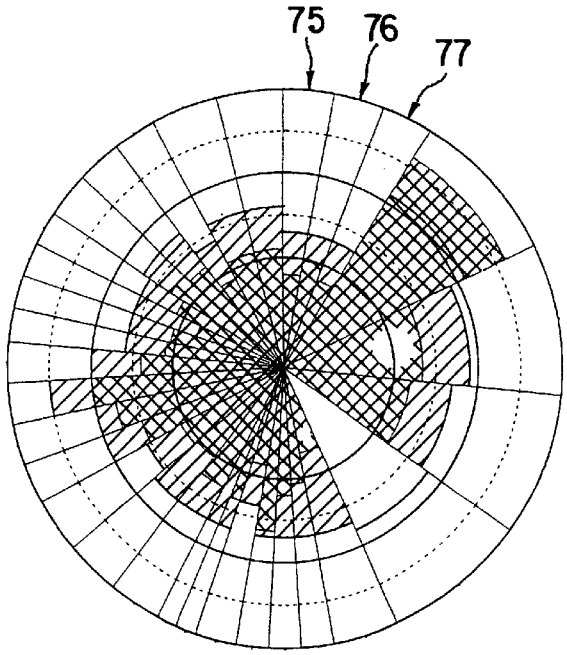

FIG. 9 shows a corresponding representation with high resolution. In this case the sectors as per FIG. 8 are resolved still further, as can be seen in particular and for example for the sector 71 for the number of weak zones in the yarn, which is here dissolved still further into sectors 75, 76 and 77 for the relative elongation, the force and the absolute elongation.

Figure 10:
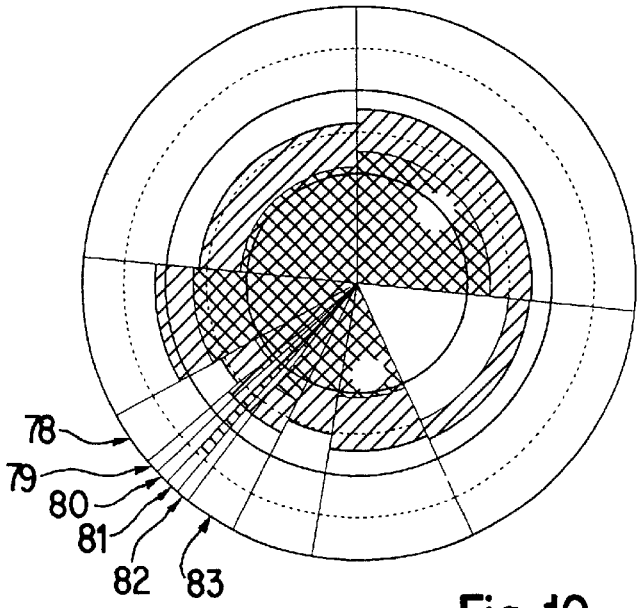

FIG. 10 shows a selective resolution of the representation according to defects in the yarn, such as those which can be determined for example from the evenness testing. The sector 76 also provided in FIG. 8 is the only one further resolved, in order to impart information selectively on a particular range of defects in the yarn. These are in particular the nep count in the sector 78, various thick places in the sectors 79 to 82 and the number of thin places in the sector 83.

The mode of operation of the method is as follows: The procedure described below can be applied in many different cases where it is necessary to provide an overview of a large number of results which have been obtained. The following description relates to the evaluation of such results that are obtained by a comprehensive testing of properties of a test specimen, in this case of a textile yarn.

First of all, measurements are carried out on yarns with test devices known per se and measured values obtained in the process are collected. This takes place from two points of view. Firstly, as a basis for the evaluation of values to be measured on a particular yarn. Such results are already available and are for example published in the already mentioned USTER STATISTICS. They include for example average or mean values measured for various parameters scatters, upper and lower limit values etc. Secondly, as measured values for many different parameters on a yarn to be tested, which are to be evaluated by means of the basis determined at the start. In addition, reference values derived from other studies are determined, which a test specimen or yarn has to meet for a particular specified application, the so-called profile or in particular yarn profile.

The actual method according to the present invention begins with measurements being carried out on a yarn for various parameters such as for example the number of thin places and thick places, the hairiness, the elongation, the maximum tensile force, the fineness, the evenness, the content of foreign fibres and foreign materials etc. A measured value is therefore obtained for example for each parameter. This can also take place for CV values or spectrogram curves, from which a characteristic value is determined, which is here regarded as the measured value. Each measured value can now be plotted on an axis or be represented by a segment of a circle. According to FIG. 1, these can be values al, bi, cl, etc. If a reference value ar, br, cr is entered on each of the same axes 1, 2, 3 and if the reference values and the measured values are connected to one another, the measurement profile 7 and the reference profile 6 are obtained. A comparison of the two profiles yields a first overview of the properties of the yarn or its quality. The scaling of the axes 1, 2, 3 takes place preferably in frequency values, which has been obtained from a comparison with a large population of test specimens, e.g. for yarn from the USTER STATISTICS.

If the graduations of the values of the parameters on the axes 8, 9, 10 (FIG. 2) are adapted to one another by a transformation in such a way that the reference values er, fr, gr lie relative to one another on the axes in such a way that they lie on a continuous curve 11, there can be assigned to measured values el, fl etc. curve sections 12, 13, which run e.g. parallel with the curve 11. The position of the measured values in relation to the reference values thus becomes apparent immediately.

According to a preferred embodiment of the invention, axes 19 to 24 (FIG. 3) are to be arranged concentrically for each parameter and the values for the parameters be so graduated or transformed that comparable reference values for all the parameters lie on circles 26 to 30. The circles 26 to 30 thus form a scale with five reference values which apply to a plurality of parameters on different axes. The latter are preferably so disposed that undesirable values indicating poor quality come to lie outside in the area of the circles 29, 30 and desirable values indicating good quality inside in the area of the circles 26, 27. In addition the circle 28 can represent a mean value and the circles 29, 30 can represent limit values which should not be exceeded. Thus circles 26 and 27 can also indicate limit values which preferably should be exceeded. The circles 28 to 30 can, as already suggested, indicate particular reference values, even if transformed reference values, or they can indicate those percentages for frequencies which are conventional in the above-mentioned USTER STATISTICS. In this case measured values must first of all be converted with the aid of the USTER STATISTICS into the statistical frequency corresponding to said value for said parameter, which statistical frequency then appears as a percentage which is entered as a measured value in the grid determined by the circles 26–30. In addition to the reference values, which are provided as circles, the measured values are to be entered here as segments or in some cases also as a curved band, as represented by the hatched area 18 in FIG. 3. In addition the width (the difference between outer and inner radius) of the band indicates the scatter of the measured values. Such a band can however also indicate the position of preferred or desirable values for the parameters. Said band or said area 18 can be continuous or exhibit discontinuities, it can exhibit a smaller or a larger diameter, it can be round or deformed to a slight extent etc. In addition the importance of individual parameters for the overall assessment is also taken into account, for the latter is determined by the angles between adjacent axes or the length of segments in the area 18. All deviations of the area 18 from the ideal circular form give an immediate indication of the quality of the yarn which was measured. It must be noted also that when reference values, in particular limit values and the scatter, are preselected, this is always done with respect to a particular goal, for example a particular use for the yarn.

In order not to have to rely on an evaluation by eye of the determined measured values in representations according to FIGS. 1 to 3, it is also possible to assign to the measured values for the selected parameters quality attributes, which are preferably determined by a fuzzy logic. A procedure is carried out for this, as can be shown with reference to FIGS. 5 and 6.

In this a measured value obtained for a parameter, for example with the aid of the USTER STATISTICS, is first of all related to other measured values. For example, if there is measured as a parameter for a combed cotton yarn of 20 Tex fineness a $CV_{Fmax}$ value of 9%, the USTER STATISTICS e.g. indicate that said value is attained by at least 50% of the comparable yarns. Said value is to be entered on the axis 43 (FIG. 5), so that a Z value of 0 is obtained on the axis 42. The evaluation of said result is then undertaken by input into the fuzzy set of FIG. 6. The value 0 is read in on the axis 45 and on the axis 46 it is read out what the functions 47, 48 and 49 state on this. The function 47 states on this that the value 0 corresponds to the desired value with a probability of 50%. The function 48 states that the value 0 can be regarded as suitable to a limited extent for the yarn with a probability of 0%. The function 49 states that the value 0 can be regarded as unsuitable for the yarn with a probability of 0%. The combination of the three statements shows that the value 0 is in fact a good value which denotes a good yarn quality. This can now be expressed in the representation according to FIG. 7, for said parameter is to be represented and evaluated there for example in the sector 61. The significance or weighting of the parameter undergoes an initial evaluation, for example, by the sector 61 being comparatively wide. The measured value is then recognized as a curve with the reference symbol 60 and the qualitative evaluation as a marking 86. The measured value therefore lies on the good side of the mean value, as indicated by the circle 28, and within the profile, as shown here by the curve 59. It can thus be assumed that the mean value 60 is at least satisfied, which is also indicated by the position of a marking 86 inside the profile.

It is also possible to undertake an overall evaluation for whole groups of parameters which are represented in adjacent sectors and to indicate the result in a separate field or a marking. For this the ratings obtained according to FIG. 6 for the individual parameters are simply combined, by for example summating or balancing all three statements for each parameter with the statements of the other parameters. A marking can also be undertaken, however, to represent the scatter of the measured values. The scatter is then represented by the size and the position of the marking relative to the center. According to FIG. 4 the yarn properties can be represented compared with two different criteria. On the one hand, a comparison with empirical values on world-wide yarn production can be represented. Data on this can be found in the above-mentioned USTER STATISTICS. There are thus assigned to the circles 26 to 30 percentiles such as 5%, 25%, 50%, 75% and 95%. On the other hand, a comparison in terms of an application for the yarn can be represented. The desirable yarn profile is then given by the bordering 87 of the single-hatched area.

In conclusion, the method will now be explained again in a different way. First of all, mean values, scatters and limit values, for example, are determined in a manner known per se for each parameter and stored in a data bank. These are the reference values and such values already exist for yarn.

In a first step a structure such as that shown for example in FIGS. 1, 2 and in particular three and 4 is laid down, in which axes or sectors 31–36 are provided for each desired parameter and where circles or curves are provided for reference values (as in FIG. 3 with reference symbols 26–30), which refer to all the sectors. In addition, there can also be provided as a further reference a profile with values which is determined by the application of the test material or other factors. In a second step, measured values are measured for a particular test material, transformed and entered in the structure as segments (labeled e.g. 37, 38) or as a whole field. An attribute can then be derived for each parameter, which represents a rating of the measured value. This can preferably be obtained with the use of a fuzzy logic or according to its laws.

Finally, all ratings of all parameters can be added up to get-an overall rating and be expressed in a field.

In order to obtain as clear and as meaningful a representation as possible of the measured values and their significance, it is very important first of all to transform the reference values in the most advantageous manner as possible and to arrange them in a structure, for example as circles. Reference values are preferably mean values, values for scatters, quantile values etc. for a selected parameter. Reference values can also determine a profile for several parameters, for yarn a yarn profile. A profile is always a stipulation with respect to an application for the yarn or test material. It incorporates, for example, stipulations of the customer for the yarn. The yarn profile is a representation of stipulated values for a plurality of parameters of a yarn and there is assigned to each parameter a mean value, a limit value and in certain cases a mean value for the scatter etc. Yarn profiles are already stipulated today by yarn customers, e.g. weaving mills etc., and serve as criteria for the acceptance of a delivery. The latter provide in most cases limit values (maximum values) and their meaningfulness can be further improved by means of additional desired values. Comparison values for many parameters are publicized in the above-mentioned USTER STATISTICS as frequency values and can be utilized for the creation of a yarn profile. Only the percentage frequency has to be indicated for the yarn profile. This can be in the ideal case an identical % value for all parameters and be the same circle in the structure. The profile can also be differentiated, however, by stipulating different % values or else absolute reference values according to the parameter. Such reference values are formed as empirical values of the production over a protracted period, or a good yarn is used as reference. Since the effort involved in the calculation of values in yarn profiles can be considerable, many values can be obtained by calculation with less effort. This can be done according to statistical laws, e.g. for the limit value from the mean value +3° scatter, for the mean value from the limit value −3° scatter or for the CV value of the scatter from the scatter and the number of samples. This can also be done by interpolation and extrapolation from values from the USTER STATISTICS, e.g. for values for thick places with 35% or 70% frequency, from the values for thick places with 50% frequency. A further possibility consists in determining values for yarn profiles from textile manufacturing laws. These are for example the known connections between fibre fineness and evenness or between CVm values and troublesome fluctuations of the yarn number or fineness. It is possible in this way to determine from known reference values for selected parameters limit values for other parameters. The yarn profile can also be constructed hierarchically and form a tree structure, such as that reproduced below. The tree structure with the trunk and with suitably indented main and subsidiary branches is shown on the left here. The latter also contains details of the test devices used and parameters evaluated with them on the right is represented, where possible, the nature of the transformation of the values for the parameters.

| | |
|---|---|
| Quality | |
| Tensile test | |
| Number of weak zones | logarithmic |
| Force | reciprocal |
| Elongation | reciprocal |
| Uster tester | |
| Evenness | |
| CVm% | |
| CV1m% | |
| spectrogram | |
| Imperfection | |
| thinplaces | sum |
| −60% | logarithmic |
| −50% | |
| −40% | logarithmic |
| thickplaces | sum |
| +35% | logarithmic |
| +50% | |
| +70% | logarithmic |
| neps | |
| +140% | logarithmic |
| +200% | |
| +280% | logarithmic |
| Fineness | |
| Ciassimat | |
| S | |
| L | |
| T | |

The meaningfulness of the representation of the measured values can be enhanced still further by the indication of quality attributes, by the segments being provided with such quality attributes. The latter can be represented by colored fields or figures, namely with colors which are known for light signals from road transport. The quality attribute can also refer to the total quality of a yarn and indicate whether the yarn is unsuitable, suitable to a limited extent, suitable, highly suitable or very highly suitable. An attribute can be assigned to measured values of a parameter whenever the measured values lie in a predetermined range. Alternatively, there can be assigned not a permanently valid attribute, but only probabilities of its validity. In this case the attribute with the greatest probability, for example, applies. Attributes from several areas can also be combined, namely according to the rules of fuzzy logic or by the addition of probabilities, with or without weighting of the probabilities. For example, the worst attribute which exceeds a defined probability can always be regarded as valid.

When determining the attributes, the scatter of the measured values for the parameters concerned can also be allowed for. When yarn samples are measured, the confidence limits in general diverge widely, since only a few measurements are available. The attributes can therefore not be reliably assigned. This fact can be allowed for by making the connection between the attribute and the measured values dependent on the scatter of the measured values. For example, measured values for a parameter are to make the yarn appear "unsuitable" only if the lower 99% confidence limit lies above the defined limit value. Similarly, the yarn can only be regarded as "good" if its upper 99% confidence limit lies below the defined limit value. This means that the more widely the confidence limits diverge, the wider will also be the range of measured values to which the attribute "unreliable" must apply. The reliability in the assignment of attributes can be increased, however, if the number of the samples or measurements is increased.

The mode of operation of the method has been represented by taking as examples parameters such as those measured on a yarn. As already suggested, however, it is not critical how the measured values were obtained or which measured values were obtained from which test specimen. A comparable effect is therefore obtained for the representation of parameters which are measured for example on a roving, a ribbon, or on fibres or flat textile materials.

What is claimed is:

1. A method of representing properties of a textile specimen in a manner easily understandable by a user, comprising the steps of:

(1) obtaining measurements of the textile specimen for a set of multiple monitored properties of the textile specimen;

(2) displaying sectors of a circle, each sector corresponding to one of the set of monitored properties to provide graphical representation of the parameters of the textile specimen by extending radii of the circle from the center of the circle to the outer boundary of the circle to form axes;

(3) plotting first values representative of measurements of each of the monitored properties, wherein for each of the monitored properties, the first values are plotted along both the axes that form the sectors that correspond to each respective one of the set of monitored properties;

(4) plotting second values representative of reference values of each of the monitored properties, wherein for each of the monitored properties, the second values are plotted along both the axes that form the sectors that correspond to each respective one of the set of monitored properties;

(5) for each sector, connecting the first values representative of measurements of the respective monitored property to which that sector corresponds with a first line; and (6) connecting the second values with a second line.

2. The method of claim 1, wherein the sectors formed in step 2 have angles between each of the axes that form the sectors which vary in magnitude proportionally to represent relative importance of the properties represented by the sectors.

3. The method of claim 1, wherein the first type of line connecting the first values representative of measurements of each of the monitored properties is an arc of a circle, which is concentric to the circle from which the various sectors are formed.

4. The method of claim 1, wherein the second type of line connecting the second values representative of measurements of each of the monitored properties is an arc of a circle, which is concentric to the circle from which the various sectors are formed.

5. The method of claim 1, wherein the first type of line is a solid line, and the second type of line is a dotted line.

6. The method of claim 3, wherein the second type of line connecting the second values representative of measurements of each of the monitored properties is an arc of a circle, which is concentric to the circle from which the various sectors are formed.

7. The method of claim 6, wherein each of the arcs connecting the second values representing reference values of each of the monitored properties are contiguous with one another, such that the combination of these arcs forms a single, continuous circle.

8. The method of claim 7, wherein the arcs connecting the first values representative of measurements of each of the monitored properties is plotted in such a manner to illustrate differences from the single circle representing the reference values, such that the circle of the reference values serves as a relative reference value, and the arcs connecting the first values in each sector are normalized according to this circle.

9. The method of claim 8, wherein the areas, contained within each of the sectors, formed by the arcs connecting the first values on each axis representative of measurements of each of the monitored properties and the axes, are filled with a shading that differs from the shading of each adjacent sector.

10. The method of claim 6, wherein additional values are plotted corresponding to additional reference values, and arcs connecting the additional plotted values are drawn.

11. The method of claim 1, wherein the reference values correspond to one of the following: limit values, desired values, mean values, and average values.

12. The method of claim 10, wherein said additional reference values correspond to one of the following: limit values, desired values, mean values, and average values.

13. The method of claim 10, wherein arcs within each sector are drawn corresponding to the maximum and minimum measured values of each parameter monitored within each sector, and the region between these arcs is shaded using a first shade, and wherein additional arcs are drawn within each sector corresponding to desired values of each property within the sector representing that property.

14. The method of claim 13, wherein the desired values are expressed as a likelihood that a desired quality characteristic is met.

* * * * *